US005540110A

United States Patent [19]

Zenmei et al.

[11] Patent Number: 5,540,110

[45] Date of Patent: Jul. 30, 1996

[54] STARTER MOTOR PINION STOPPER PLACEMENT

[75] Inventors: Keisaku Zenmei; Shuzo Isozumi, both of Himeji, Japan

[73] Assignee: Mitsubishi Denki Kabushiki Kaisha, Tokyo, Japan

[21] Appl. No.: 384,868

[22] Filed: Feb. 7, 1995

[30] Foreign Application Priority Data

Sep. 13, 1994 [JP] Japan ..... 6-247131

[51] Int. Cl.[6] ..... F02N 11/02

[52] U.S. Cl. ..... 74/7 A; 74/6; 384/903

[58] Field of Search ..... 74/6, 7 A; 384/903

[56] References Cited

U.S. PATENT DOCUMENTS

| | | | |
|---|---|---|---|
| 2,947,174 | 8/1960 | Lafitte | 74/6 |
| 4,926,706 | 5/1990 | Isozumi | 74/7 A |
| 4,944,192 | 7/1990 | Morishita et al. | 74/6 |
| 5,000,054 | 3/1991 | Morishita et al. | 74/6 |
| 5,081,366 | 1/1992 | Isozumi | 74/6 |
| 5,101,114 | 3/1992 | Isozumi et al. | 74/6 |

FOREIGN PATENT DOCUMENTS

| | | |
|---|---|---|
| 190967 | 8/1989 | Japan . |
| WO8804489 | 6/1988 | WIPO . |

OTHER PUBLICATIONS

Patent Abstracts of Japan, vol. 13, No. 484, Nov. 2, 1989.

*Primary Examiner*—Charles A. Marmor
*Assistant Examiner*—David Fenstermacher
*Attorney, Agent, or Firm*—Sughrue, Mion, Zinn, Macpeak & Seas

[57] ABSTRACT

A starter has an output shaft 3*a*, an overrunning clutch 4 and a pinion 12 carried on the output shaft, a stopper 21 carried on the output shaft at the front of the pinion to restrict the displacement of the overrunning clutch and the pinion, and a front bearing 16 for supporting the front end of the output shaft. The stopper is formed in a cylindrical shape and is supported by an inner peripheral portion of the front bearing, and a ring 22 for fixing the stopper is fitted into a groove 23*a* which is formed in the output shaft at the front of the front bearing.

10 Claims, 3 Drawing Sheets

STARTER MOTOR PINION STOPPER PLACEMENT

BACKGROUND OF THE INVENTION

1. Field of the Invention

The present invention relates to the arrangement of a pinion stopper in an engine starter motor.

2. Discussion of the Prior Art

Referring to FIG. 4, there is shown a cross sectional view of a conventional starter, as disclosed in e.g. Japanese Unexamined Patent Publication No. 190967/1989. Referring to FIG. 5, there is shown in an enlarged cross sectional view of a stopper and its surroundings in the starter.

In these Figures, reference numeral 1 designates a the starter as a whole, reference numeral 2 designates an armature, reference numeral 3 designates an armature rotary shaft, reference numeral 3*a* designates an output shaft, reference numeral 4 designates an overrunning clutch, reference numeral 5 designates a front bracket, and reference numeral 6 designates a switch coil. Reference numeral 7 designates a movable core, reference numeral 8 designates a movable switch contact, reference numeral 9 designates a fixed contact, reference numeral 10 designates a return spring, reference numeral 11 designates a lever, and reference numeral 12 designates a pinion. Reference numeral 13 designates a ring gear, reference numeral 14 designates the stopper, reference numeral 15 designates a stopper fixing ring which is fitted into a groove 3*b* formed in the output shaft 3*a* at a leading end of the rotary shaft 3, reference numeral 16 designates a front bearing, reference numeral 17 designates a cap, and reference numeral 18 designates a washer.

Now, the operation of the starter will be explained. When the switch coil 6 is energized, the movable core 7 is attracted to the left to extend the overrunning clutch 4 outwardly or forwardly via the lever 11, causing the pinion 12 to engage the ring gear 13. At the same time, the movable contact 8 engages the fixed contact 9 to enable a large current flow in the electric motor, producing torque to start an engine. At that time, the displacement of the overrunning clutch 4 is restricted because the pinion 11 engages the stopper 14.

On the other hand, when the current is cut off in the switch, the return spring 10 acts on the movable core 7, returning the overrunning clutch to its original position via the lever 11. In that manner, the operation is completed.

In the conventional device, the stopper 14 for restricting the displacement of the overrunning clutch 4, the ring 15 for fixing the stopper 14, and the ring groove 3*b* with the ring fixed therein are arranged behind the front bearing 16. In such an arrangement, the impact force generated when the pinion 12 engages the ring gear 13 concentrates on the ring groove 3*b*. As a result, the diameter of the output shaft is subject to a dimensional limitation in terms of strength. The minimum level has been that the number of pinion teeth is 8 in the case of a module of 2.54 (Pd10) and 9 in the case of module of 2.117 (Pd127).

In addition, in order to receive a thrust load in such an arrangement, the output shaft has a stepped portion 3*c* in abutment with the washer 18 which is press fitted behind the front bearing 16. The front bracket 5 has the cap 17 caulked at a front end thereof for dust sealing.

In general, the size of the electric motor unit is inversely proportional to the gear ratio of a ring gear to a pinion. If the number of pinion teeth is decreased to, e.g. 7 in the case of a module of 2.54 or 8 in the case of a module of 2.117 in order to make the electric motor unit compact, the thickness of the root of the pinion teeth becomes thinner in the conventional structure because the diameter of the output shaft cannot be made smaller due to its strength at the ring groove. Such an arrangement can not ensure the necessary strength required for the pinion, creating a problem in that a decrease in the number of the pinion teeth can not be attained in the conventional structure.

SUMMARY OF THE INVENTION

It is an object of the present invention to solve the problem in the conventional structure, and to provide a starter capable of having the number of pinion teeth set to 7 in the case of a module of 2.54 and to 8 in the case of a module of 2.117, and increasing the gear ratio of an engine ring gear to a pinion to make an electric motor unit smaller and lighter.

The foregoing and other objects of the present invention have been attained by a starter comprising an output shaft; an overrunning clutch and a pinion carried on the output shaft; a stopper carried on the output shaft to the front of the pinion to restrict the displacement of the overrunning clutch and the pinion; and a front bearing for supporting a front end portion of the output shaft; wherein the stopper is formed in a cylindrical shape and is supported by an inner peripheral portion of the front bearing, and a ring for fixing the stopper is fitted into a groove which is formed in the output shaft to the front of the front beating.

It is preferable that the clearance between the stopper and the front bearing is larger than that between the output shaft and the stopper.

It is preferable that the stopper is engaged with the output shaft by spline connection.

It is preferable that a thrust load which is created when the pinion protrudes is received by a leading edge of the output shaft.

It is preferable that a thrust washer is arranged to the front of the front bearing so as to be opposed to a leading edge surface of the output shaft.

It is preferable that a portion of the output shaft with the stopper carried thereon is connected to a portion of the output shaft with the pinion carried thereon by a gentle curved transitional portion.

In accordance with the present invention, the cylindrical stopper is supported by the inner peripheral portion of the front bearing, and the stopper fixing ring groove on the output shaft is arranged to the front of the front bearing. As a result, there is no ring groove which is notched on the output shaft around the pinion behind the bearing. This arrangement allows the diameter of the output shaft with the pinion carried thereon to be set to a smaller size and the number of pinion teeth to be decreased so as to make the electric motor portion smaller and lighter.

In addition, when the clearance between the stopper and the bearing is made to be larger than that between the output shaft and the stopper, or the stopper is engaged with the output shaft by spline connection to obtain slidable rotation between the stopper and the bearing, the ring can be prevented from being worn.

Further, when a thrust load is received by the leading edge of the output shaft, or the thrust washer is mounted to the output shaft to the front of the front bearing by press fit, such an arrangement can receive the thrust load in a sufficient manner, and ensure enough thickness of a housing at the press fit portion to make the quality stable, offering an advantage in that the conventional end cap can be eliminated to decrease the number of the required parts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
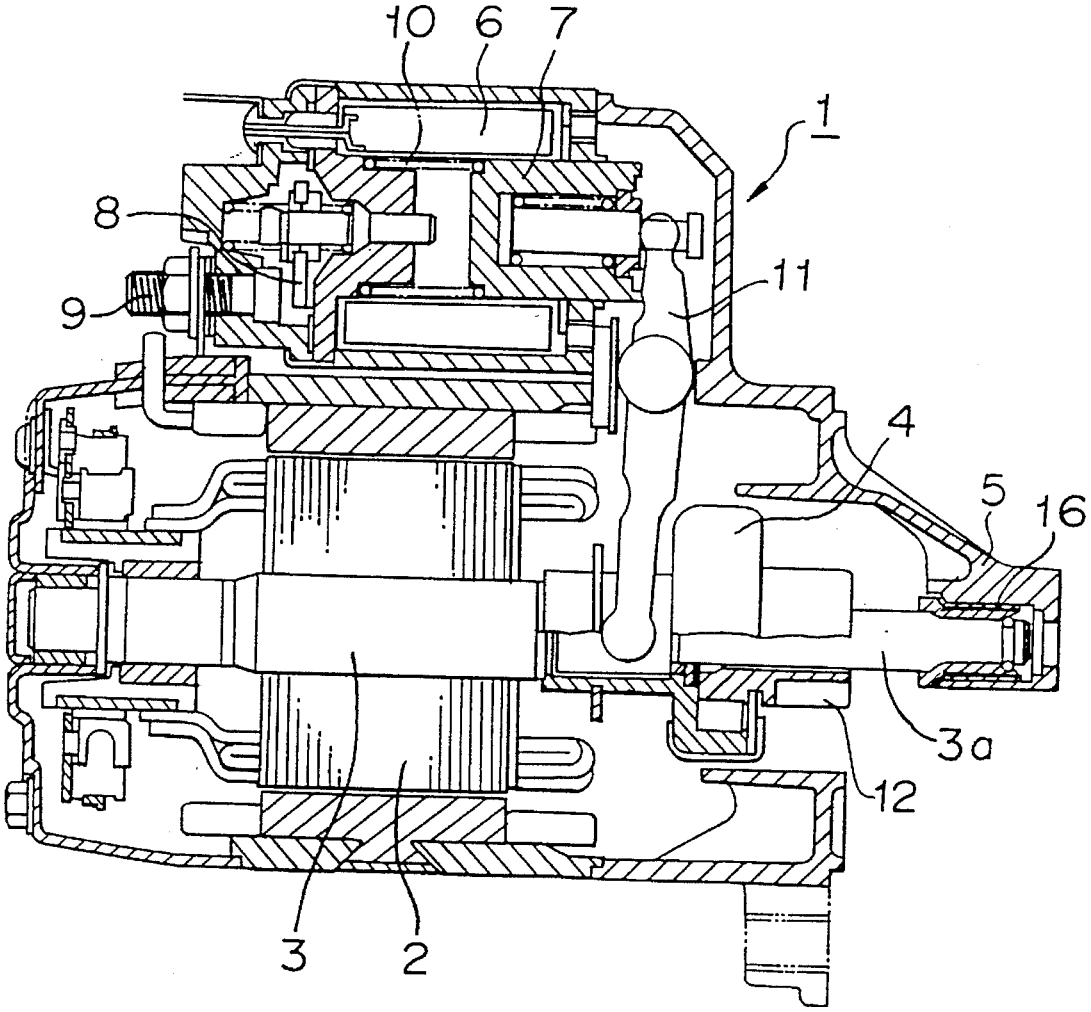
FIG. 1 is a cross sectional view of an embodiment of the starter according to the present invention.
Figure 2:
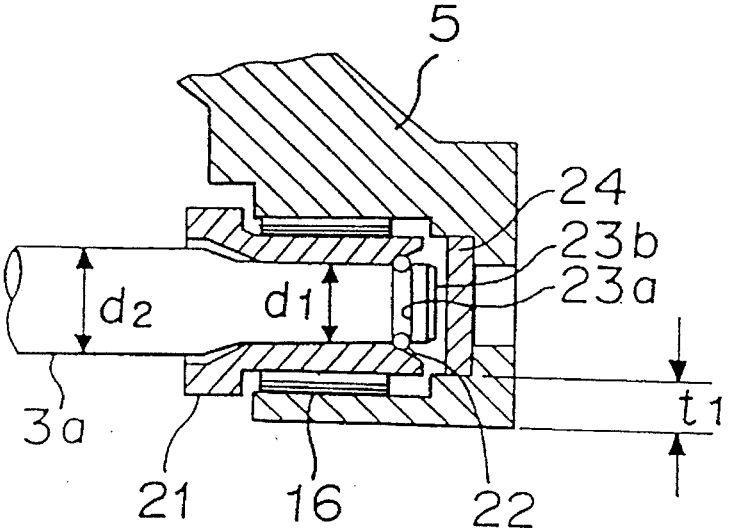
FIG. 2 is an enlarged cross sectional view showing in detail the stopper and its surroundings shown in FIG. 1.

EMBODIMENT 1:

Now, an embodiment of the present invention will be described in detail with reference to the accompanying drawings. Referring now to FIG. 1, there is shown a cross sectional view of the first embodiment of the starter according to the present invention. Referring to FIG. 2, there is shown an enlarged cross sectional view of the stopper and its surroundings as shown in FIG. 1.

In those Figures, reference numeral 4 designates an overrunning clutch, reference numeral 5 designates a front bracket, reference numeral 12 designates a pinion, and reference numeral 16 designates a front bearing. Those elements, including an electric motor unit and an electric magnetic switch portion, are the same as in the conventional device. Reference numeral 21 designates a cylindrical stopper which is fitted in an inner peripheral wall of the front bearing 16. The stopper includes a cylindrical body and a cylindrical flange integrally formed at a rear end of the cylindrical body. The cylindrical flange has a greater outer diameter than that of the cylindrical body. The flange also has a greater inner diameter than the cylindrical body in terms of its inner peripheral wall. Between the inner peripheral wall of the stopper body and that of the flange is formed a tappered portion which gradually expands toward the flange to define a continuous connection between both walls. The stopper 21 is fixed by a ring 22 at a front end portion of the output shaft, and a groove 23*a* for fixing the ring is arranged on the output shaft to the front of the front bearing 16. In such an arrangement, there is no ring groove formed behind the front bearing, and which receives a reactive force which is generated by the engagement shock of the pinion and the ring gear. As a result, the diameter of the output shaft 3*a* with and the pinion carried thereon can be reduced, the root thickness of the pinion teeth can be ensured in a sufficient manner, with the number of the pinion teeth being 7 in the case of a module of 2.54 and 8 in the case of a module of 2.117.

A portion of the stopper 21 which is engaged with the ring 22 lies to the front of the front bearing 16, and a portion of the stopper which engages and halts the pinion 12 lies behind the front bearing. The stopper 21 has an elongated shape in the axial direction as shown in FIG. 2, and the front bearing supports the stopper 21.

Although the diameter $d_1$ of a portion of the output shaft with the stopper carried thereon is smaller than the diameter $d_2$ of the portion of the output shaft with the pinion carried thereon because of dimensional limitations around the bearing portion of the front bracket 5, no torsional stress concentration results because the ring groove 23*a* is arranged outwardly of the front bearing 16. The difference between $d_1$ and $d_2$ creates no problem in terms of strength since the portion of the output shaft with the stopper and the portion of the output shaft with the pinion are connected by a gently curved transitional portion.

In addition, in order that the stopper 21 and the front bearing 16 can slidably rotate relative to one another when the starter operates, the clearance between the stopper and the front bearing is larger than the clearance between the stopper and the output shaft.

When the washer is arranged behind the bearing as in the conventional device, the washers is spared from the stopper and can not receive a thrust load in a sufficient manner. In this invention a washer 24 is arranged to the front of the front bearing by press fit, and a thrust load can thus be accommodated if a leading edge 23*b* of the output shaft collides against the washer, which allows the thrust load to be countered in a sufficient manner. Since the washer 24 is located at a leading end of the front bracket 5, the washer can work as a cap as well, eliminating the conventional cap 17.

Figure 5:
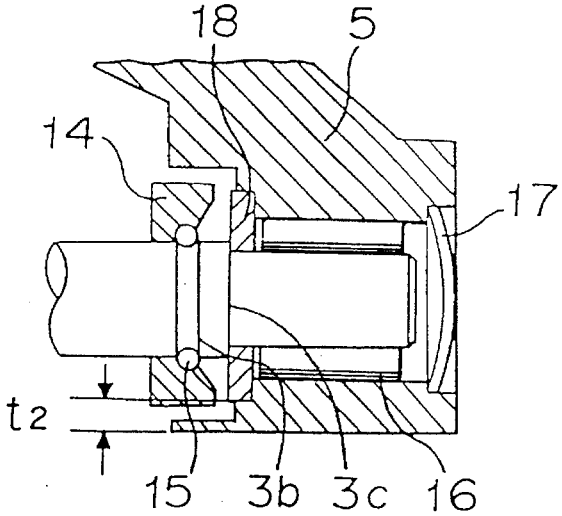
FIGURE 5 PRIOR ART
FIG. 5 is an enlarged cross sectional view showing in detail the stopper and its surroundings shown in FIG. 4.

In addition, when the wall thickness of a portion of the front bracket where the washer 24 is press fitted in the first embodiment is compared to that in the conventional device, i.e. $t_1$ of FIG. 2 is compared to $t_2$ of FIG. 5, $t_1>t_2$ is there found. The first embodiment is advantageous in terms of avoiding a housing crack in press fitting the washer, facilitating outer diameter control of the washer.

Figure 3:
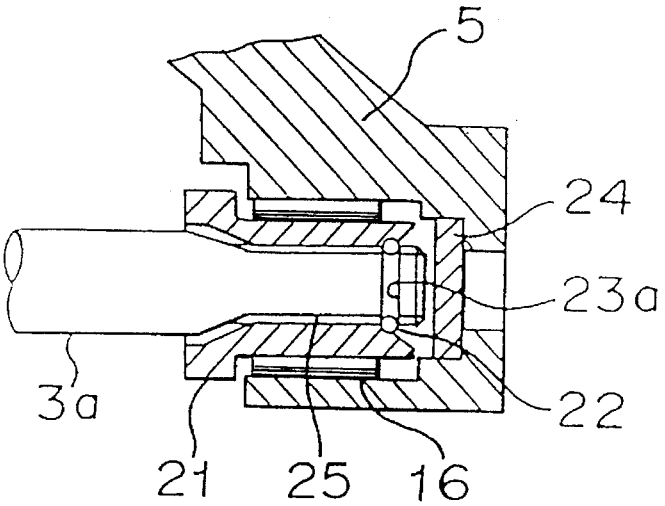
FIG. 3 is a cross sectional view of a second embodiment of the starter according to the present invention.
Figure 4:
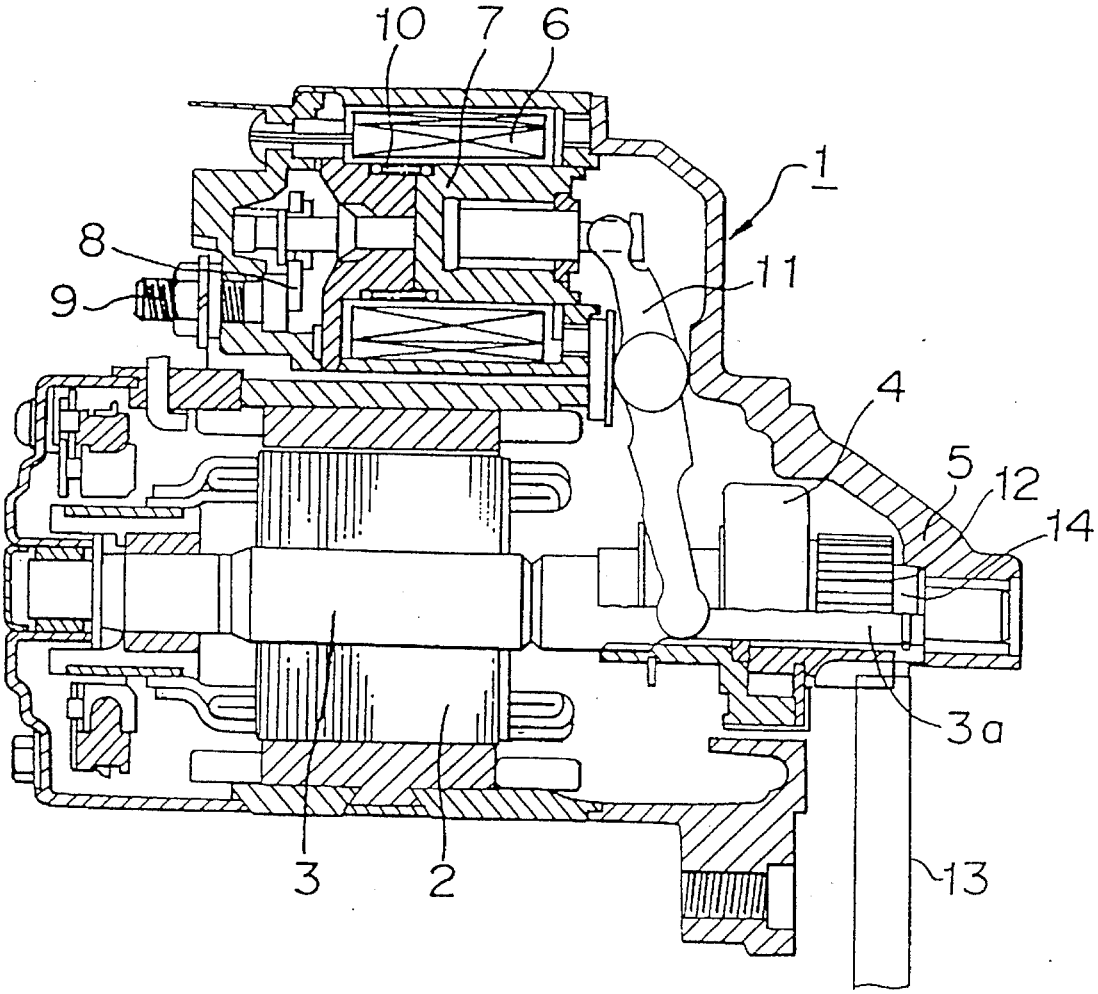
FIGURE 4 PRIOR ART
FIG. 4 is a cross sectional view of a conventional starter.

EMBODIMENT 2:

Although, in the first embodiment, the clearance between the stopper 21 and the front bearing 16 is larger than that between the stopper and the output shaft 3*a* to facilitate slidable rotation between the stopper and the front bearing at the time of activating the starter, the stopper may be connected to the output shaft by a spline engagement 25 as shown in FIG. 3 in order to further ensure slidable rotation between the stopper and the bearing.

Obviously, numerous modifications and variations of the present invention are possible in light of the above teachings. It is therefore to be understood that within the scope of the appended claims, the invention may be practiced otherwise than as specifically described herein.

What is claimed is:

1. A starter motor drive assembly, comprising:

a) an output shaft (3*a*);

b) an overrunning clutch (4) and a pinion (12) carried on the output shaft;

c) a stopper (21) mounted on the output shaft, outwardly of the pinion, to restrict an outward displacement of the overrunning clutch and the pinion; and d) a cylindrical front bearing (16) mounted in a front bracket (5) for supporting an outermost end of the output shaft;

e) wherein the stopper is formed in a cylindrical shape and is rotatably supported within an inner periphery of the front bearing over the full axial length thereof, and an annular ring (22) is fitted both into an annular groove (23*a*) formed in the output shaft outwardly of the front bearing and into a complementary groove formed in an inner periphery of the stopper proximate an outermost end thereof to retain the stopper axially immovable relative to the output shaft.

2. A starter motor drive assembly according to claim 1, wherein a clearance between the stopper and the front bearing is larger than that between the output shaft and the stopper.

3. A starter motor drive assembly according to claim 1, wherein the stopper is engaged with the output shaft by a spline connection.

4. A starter motor drive assembly according to claim 1, wherein a thrust load created when the pinion is displaced outwardly is borne by a leading edge of the output shaft.

5. A starter motor drive assembly according to claim 4, wherein a thrust washer (24) is arranged outwardly of the front of the front bearing so as to be opposed to a leading edge surface of the output shaft.

6. A starter motor drive assembly according to claim 1, wherein the stopper includes a cylindrical body, and a cylindrical flange integrally formed at an innermost end of the cylindrical body.

7. A starter motor drive assembly according to claim 6, wherein the cylindrical flange has a greater outer diameter than that of the cylindrical body.

8. A starter motor drive assembly according to claim 7, wherein the flange has a greater inner diameter than an inner peripheral wall of the cylindrical body.

9. A starter motor drive assembly according to claim 8, wherein a tapered portion extends between the inner peripheral wall of the stopper body and that of the flange to define a continuous connection between both walls.

10. A starter motor drive assembly according to claim 1, wherein a portion of the output shaft with the stopper mounted thereon is connected to a portion of the output shaft with the pinion carried thereon by a gently curved transitional portion.

* * * * *